US008448773B2

(12) United States Patent
Dunlop et al.

(10) Patent No.: US 8,448,773 B2
(45) Date of Patent: May 28, 2013

(54) BILL AND VOUCHER/TICKET HANDLING APPARATUS

(75) Inventors: Peter Dunlop, Oldham (GB); David Bellis, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 12/679,552

(22) PCT Filed: Oct. 23, 2008

(86) PCT No.: PCT/GB2008/003601

§ 371 (c)(1),
(2), (4) Date: May 24, 2010

(87) PCT Pub. No.: WO2009/053705

PCT Pub. Date: Apr. 30, 2009

(65) Prior Publication Data

US 2011/0036681 A1 Feb. 17, 2011

(30) Foreign Application Priority Data

Oct. 25, 2007 (GB) ..... 0720931.5

(51) Int. Cl.
*G07F 7/04* (2006.01)

(52) U.S. Cl.
USPC ..... 194/206

(58) Field of Classification Search
USPC . 194/206, 302, 350; 902/18, 23, 36; 209/534; 235/379; 101/66
See application file for complete search history.

(56) References Cited

U.S. PATENT DOCUMENTS

| | | | | |
|---|---|---|---|---|
| 4,540,081 | A | 9/1985 | Mori et al. | |
| 5,010,485 | A * | 4/1991 | Bigari | 705/17 |
| 6,648,761 | B1 | 11/2003 | Izawa et al. | |
| 6,758,393 | B1 * | 7/2004 | Luciano et al. | 235/379 |
| 7,637,422 | B2 * | 12/2009 | Kwak et al. | 235/379 |
| 2002/0043546 | A1 * | 4/2002 | Luciano et al. | 225/100 |
| 2004/0204233 | A1 * | 10/2004 | Saffari et al. | 463/25 |
| 2005/0040006 | A1 * | 2/2005 | Kodela et al. | 194/206 |
| 2006/0064379 | A1 * | 3/2006 | Doran et al. | 705/42 |

FOREIGN PATENT DOCUMENTS

| | | |
|---|---|---|
| DE | 19805613 | 8/1999 |
| WO | WO01/95262 | 12/2001 |

* cited by examiner

*Primary Examiner* — Mark Beauchaine
(74) *Attorney, Agent, or Firm* — Woodard, Emhardt, Moriarty, McNett & Henry LLP

(57) ABSTRACT

The invention relates to apparatus for use in the handling of banknotes, tickets and/or vouchers. The apparatus allows the same to be inserted into the apparatus through an aperture and to then be fed to storage or a printing apparatus. The apparatus allows the dispensing of bills, tickets or vouchers and the same are dispensed through the same aperture thereby reducing the size of the apparatus as only one aperture and feed means is required for inserting and dispensing which is in contrast to known apparatus which have an aperture for inserting and a separate aperture via which the banknotes, tickets or vouchers are dispensed.

14 Claims, 2 Drawing Sheets

BILL AND VOUCHER/TICKET HANDLING APPARATUS

REFERENCE TO RELATED APPLICATIONS

This application is the U.S. nationalization of PCT/GB2008/003601, filed 23 Oct. 2008. This application claims priority from Patent Application No. GB 0720931.5, filed 25 Oct. 2007.

The invention to which this application relates is apparatus which can be used to accept, validate and process bank notes or bills, hereinafter referred to as bills, and tickets or vouchers, which have information applied thereto which is representative, typically, of a sum of money.

The automated handling of bills, is known and the demand for apparatus which handles the bills effectively, is increasing. The demand typically arise in environments such as casinos, car parks, or any environment in which there is a need for the input of cash to a particular value, in order for an item of apparatus to be used or a service to be provided. Furthermore, as the provision of items of apparatus, increase there is a need for the apparatus to be able to effectively and automatically handle individual bills or tickets, without the need for human employee intervention.

The known bill and ticket handling device, is typically required to be incorporated within a larger item of apparatus which is provided to perform a particular function such as for example to allow the playing of a casino game. As the larger item of apparatus is typically of a predetermined size, the amount of available space within that apparatus for the bill and ticket handling device, is limited. This means that the design of any such device is typically restricted to be within specific parameters.

Typically, the bill and ticket handling device will comprise a first inlet aperture into which bills or tickets may be input by the user into the apparatus. The inlet leads to a feed means, which effectively grips the bill or ticket and moves the same to an analysis and check location which detects the presence of the bill or ticket, and the value of the same, as well as performing other security functions. If the bill or ticket is accepted, then the value of the same is allocated to the user to allow use of the apparatus and the bill or ticket is typically placed into a storage container for subsequent retrieval.

In certain instances, such as for example, if the user plays the apparatus and wins a prize, or perhaps requests a receipt for a particular payment, there is a need for a ticket or voucher to be printed and presented to the user. Conventionally there is provided as part of the bill and voucher processing device a separate outlet or aperture through which a printed ticket or voucher is presented from the apparatus to the user. The outlet or aperture typically is connected to printer which is located within the apparatus, and with a feed path to the outlet such that the printer will, upon receiving specific commands, print the information onto the ticket or voucher and the ticket or voucher is then fed to the outlet to protrude from the apparatus and allow the same to be gripped by the user to be removed from the apparatus.

It is found that in practice, the need to have an inlet through which bills or tickets or vouchers, can be placed into the apparatus, and a separate outlet via which tickets or vouchers may be presented by the apparatus to the user, is difficult to achieve given the space constraints of the overall apparatus in which the bill and voucher processing device is located. Furthermore, the need to have separate feed means for the inlet and outlet, can mean that the cost of the apparatus is relatively high and the possibility of failure of the apparatus can also be increased.

The aim of the present invention is therefore to provide apparatus whereby the input of bills or vouchers by a user into the apparatus, and the presentation of bills and/or vouchers to the user of the apparatus is provided in a more efficient manner and in a way which allows more efficient utilisation of the space which is available in said apparatus.

In a first aspect of the invention, there is provided apparatus for the receipt and provision of bills and/or vouchers, said apparatus incorporating an aperture through which bills or vouchers can pass between said apparatus and a user, and feed means which cause the passage of the bill and/or voucher within said apparatus and wherein the feed means leading to and from the aperture can be driven in forward and reverse directions selectively so as to allow a bill or voucher to be moved in a first direction from the aperture into the apparatus and in a second direction from the apparatus to the aperture.

Typically, therefore the aperture through which the bill or voucher can be placed into the apparatus is the same aperture through which a bill or voucher passes to leave the apparatus.

In one embodiment the bill or voucher which leaves the apparatus may be the same bill or voucher which is placed into the apparatus by the user in the same condition, or may be the same bill or voucher in an adapted form or has been selected from storage means and/or bill or voucher creating means within the apparatus and in which case is different to any bill or voucher which has been input by the user In one embodiment, the device includes a printer. In one embodiment said printer is located at an end of the feed means opposing said aperture and the feed means.

In one embodiment, the printer is provided to allow the printing of information onto paper or card to create a ticket or voucher, said ticket or voucher, once printed, being passed by the feed means to the aperture to allow the same to be received and removed from the device by the user.

Typically the information which is printed on the ticket or voucher, represents a sum of money which has been won by the user or is a receipt representative of the sum of money which may have been input by the user.

In one embodiment, the ticket or voucher has applied thereto, a machine readable code which is representative of the cash value and in one embodiment, the said code may be a bar code.

In one embodiment of use, the device allows the input of a bill or voucher and the feed means moves the bill and voucher to a position at which analysis of the bill or voucher can be performed in order to identify that the same is valid and typically also the value represented by the bill and voucher. If the bill or voucher is indicated as being acceptable, then the same is passed into a storage location. Also if a ticket or voucher is printed by the printer, said ticket or voucher is moved by the feed means from the printer to the aperture.

In one embodiment, a second feed means may be provided which moves the bill or voucher to the storage location in a direction substantially perpendicular to the direction of the first feed means.

In one embodiment, the printer is located intermediate the aperture and the storage location.

In one embodiment, the analysis means can be used to detect one or more features of the printed ticket or voucher.

By providing the apparatus in accordance with the current invention, so the provision of a single aperture can be used to allow both the feeding in and feeding out of bills and/or tickets. The ability to do this, by the reversal of operation of the feed means, at least between the aperture and the printer location means that the single aperture can be used and thereby reduces the amount of space which is required for the installation of the device in accordance with the invention.

When one considers that the space which is available is already restricted, it will be appreciated that the freeing up of any space is an important advantage that is obtained by the current invention.

In a further aspect of the invention there is provided apparatus for the receipt and provision of bills and/or vouchers, said apparatus incorporating an aperture through which bills or vouchers can pass between said apparatus and a user, and feed means which cause the passage of the bill and/or voucher within said apparatus and wherein feed means leading to and from the aperture can be driven in a forward direction so as to allow a bill or voucher to be moved in a first direction into the apparatus and in a second direction so as to allow a bill or voucher printed by the apparatus to move from the printer to external of the apparatus.

Specific embodiments of the invention are now described with reference to the accompanying drawings wherein;

FIGS. 1*a* and *b* illustrate perspective views of apparatus in accordance with one embodiment of the invention.

Figure 1B:
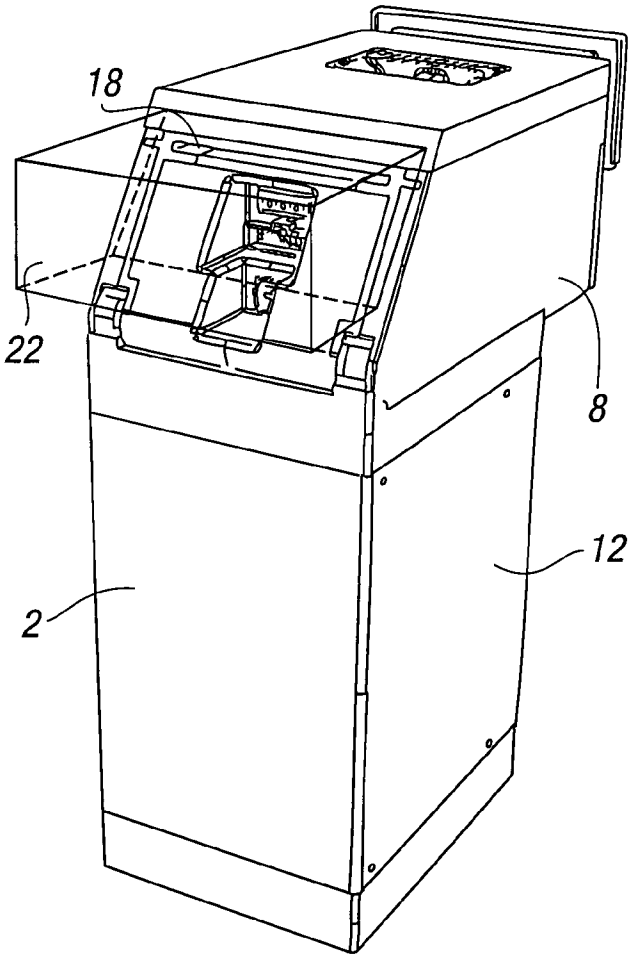
Figure 1A:
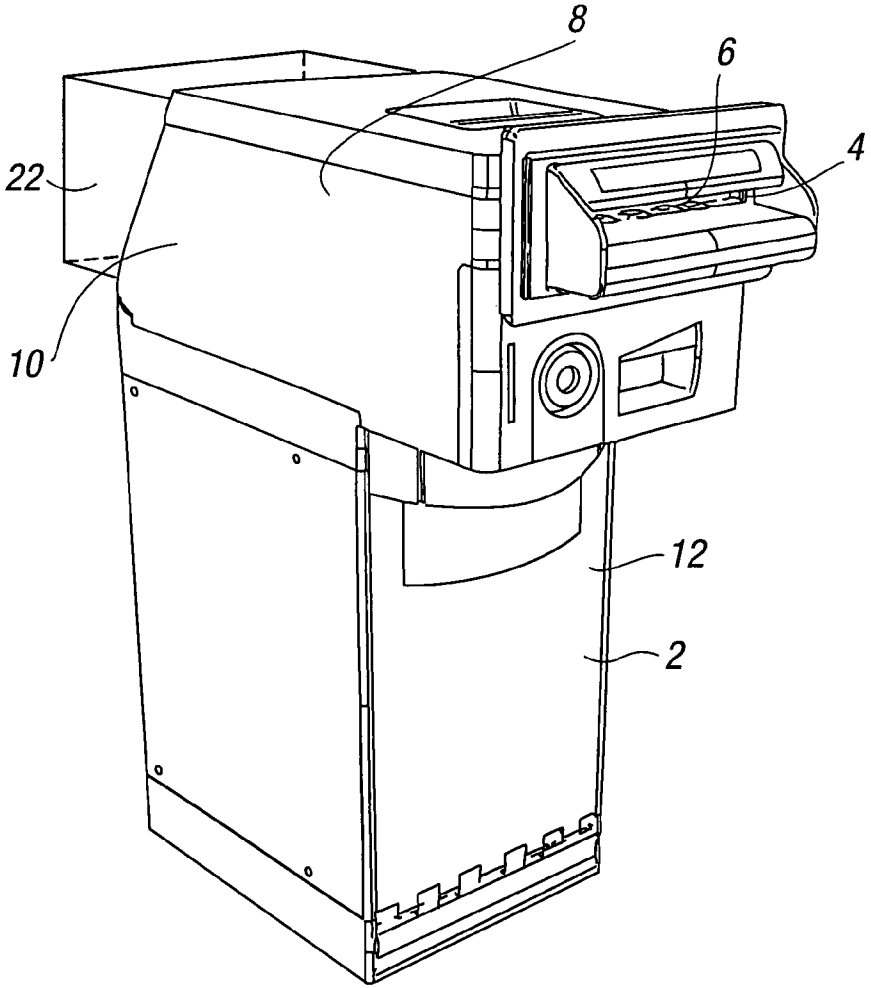

Referring firstly to FIGS. 1*a* and *b*, there is illustrated apparatus 2 for the processing of bills, tickets or vouchers. The apparatus includes an aperture 4 which is typically located so as to be accessible externally of a larger item of apparatus in which the apparatus of the invention is installed. For example, in this case, the device may be installed in a casino gaming apparatus so as to allow a player of the gaming apparatus, to input bills or vouchers and have the value of those bills or vouchers allocated to the gaming unit so as to allow one or more games to be played. Alternatively the apparatus may be provided within payment apparatus such as that provided for making payment of a parking ticket.

The aperture 4 is provided of a size so as to allow bills of certain denominations in a particular currency, to be received therethrough and/or also to allow the receipt of vouchers, reference to which hereonin also incorporates tickets. The aperture leads to feed means 6 within the device which are provided to grip the leading edge of the bill or voucher, as it is input into the aperture. The feed means then serve to pass the bill or voucher, to a location at which there is provided analysing means 8 which can be of a conventional form and which allow certain features of the bill or voucher to be assessed. The features can be for example, to assess, with regard to bills, that the bill is of a correct denomination, that the bill is authentic and/or the specific value of the bill. With regard to a voucher, the assessment may be to analyse the particular machine readable code printed on the ticket so as to assess whether the same is genuine and again allocate a particular value. If the bill or voucher is regarded as being genuine once the analysis has been performed, the bill or voucher can be passed to second feed means 10 which drive the bill or voucher, to a storage location 12, typically in the form of a cartridge into which the bills or vouchers can be placed for storage in a secure manner until the cartridge is subsequently retrieved.

Intermediate the first and second feed means, there is provided a further passage 18 which is typically inline with the direction of movement of the bill or voucher through the first feed means. This passage leads to a printer 22, not shown in detail for ease of illustration but which can be of a conventional type.

In accordance with the invention, the printer 22 is provided to receive control signals which cause the printer to print information onto sheet material such as to generate a ticket or voucher on paper or card supplied thereto. The generation of the voucher is achieved by printing onto a preformed or cut portion of paper or card, information representative of the control signal received.

In one embodiment, the information may be, for example, in the case where the apparatus is provided as part of a gaming unit, the provision of a voucher which has a particular value of a win which has been achieved by the user in the gaming unit. Thus, rather than paying bills out to the user, the voucher can be generated at the printer and moved by the first feed means to the aperture to be collected by the player from the apparatus and then used by the player in the same or other gaming units or may be taken to be changed into cash.

In another embodiment, when the apparatus is used in conjunction with, for example a pay station the voucher which may be generated by the printer, may be a receipt which is indicative of a particular monetary value which has been input into the apparatus by a user as payment.

In accordance with the invention, when the voucher has been created by the printing means 22, the feed means 6 are controlled so as to move the voucher in a direction towards the aperture 4 and to move at least a portion of the voucher through the aperture so as to be available externally of the device. This therefore allows the user to grip the voucher and remove the same from the device and then use the same as they wish.

Figure 2:
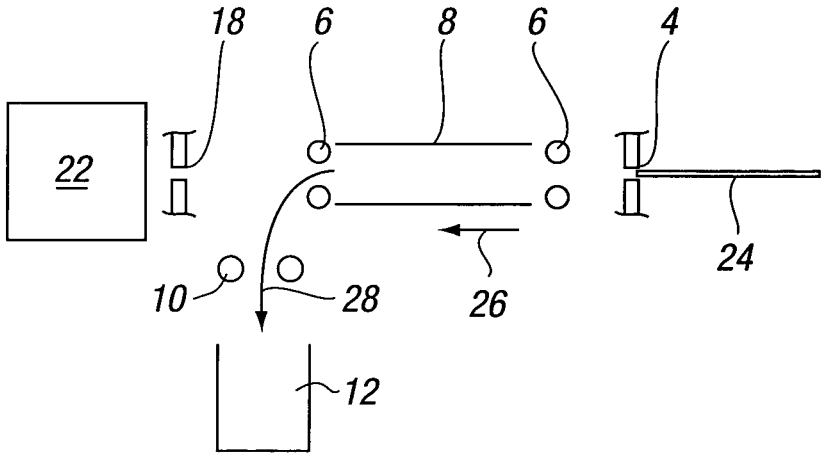
FIG. 2 illustrates, in a schematic manner, the path followed by bills or tickets which are input into the apparatus.

FIG. 2 illustrates in a schematic manner, the direction of movement of a bill or voucher 24 which has been input into the device through aperture 4 and it will be seen that in the first feed means 6, the bill or voucher 24 moves in a direction as indicated by arrow 26 and in the second feed means 10 the bill or voucher is moved in the direction of arrow 28 in a substantially perpendicular direction into a storage location 12. At the end of the first feed means 6 and the start of the second feed means 10, there is provided the passage 18 leading to the printer 22. It should be appreciated that typically the bill or voucher will only reach the second feed means once the same has been analysed and been deemed to be valid. If found to be invalid the feed means 6 will be reversed to direction 32 and the bill or voucher is fed back to the aperture 4.

Figure 3:
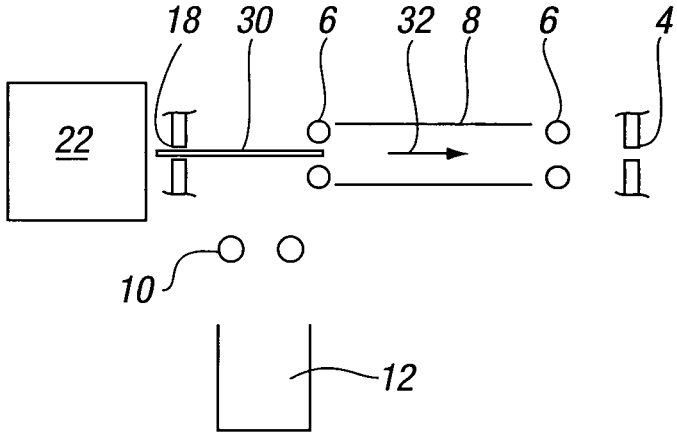
FIG. 3 illustrates, in a schematic manner, the path followed by a ticket or voucher which is generated by the apparatus and which leads the apparatus through the aperture in accordance with the invention.

FIG. 3 illustrate how a bill or voucher 30 which is generated by the printer 22, is moved through the first feed means 6 in reverse direction 32, to the aperture 4 and it will therefore be appreciated that the direction of movement of the first feed means 6 is required to be controlled so as to be moved in the first direction 26 as indicated in FIG. 2 and a second direction 32 as indicated in FIG. 3.

There is provided, in accordance with the invention, apparatus which allows the input and output of bills or vouchers through a common aperture 4. The ability to achieve this, means that the other areas or spaces within the general apparatus into which the apparatus in accordance with the invention is installed, is freed up as there is no longer a need for a separate aperture and separate printing apparatus to be installed at a separate location on the overall apparatus.

The invention claimed is:

1. Apparatus for the receipt and provision of bills and/or vouchers, said apparatus including a printer provided to allow the printing of information onto a paper or card to create a voucher and further incorporating an aperture through which bills or vouchers can pass between said apparatus and a user, and feed means which cause the passage of the bill and/or voucher within said apparatus and characterised in that the feed means leading to and from the aperture can be driven in a first, forward direction and second, reverse direction selectively so as to allow a bill or voucher to be moved in a first direction from the aperture into the apparatus and in a second direction from the apparatus to the aperture and the aperture through which the bill or voucher is placed into the apparatus is the same aperture through which a bill or voucher passes to leave the apparatus and the printer is located at an end of the feed means opposing an end at which said aperture is located such that said voucher, once printed, is passed by the feed means to the said same aperture to allow the same to be received and removed from the device by a user.

2. Apparatus according to claim 1 characterised in that the paper or card is fed into the apparatus via the aperture and moved to the printer to be printed on and then fed in reverse to the aperture by the feed means.

3. Apparatus according to claim 1 characterised in that the information which is printed on the voucher, represents a sum of money which has been won by the user via a means with which the apparatus is incorporated or connected.

4. Apparatus according to claim 1 characterised in that the information which is printed on the voucher is a receipt representative of the sum of money which has been input by the user into a means with which the apparatus is incorporated or connected.

5. Apparatus according to claim 1 characterised in that the ticket or voucher has applied thereto, a machine readable code which is representative of a cash value.

6. Apparatus according to claim 1 characterised in that an input bill or voucher is moved by the feed means to a position at which analysis of the bill or voucher is performed in order to identify that the same is valid and/or the value of the bill or voucher.

7. Apparatus according to claim 6 characterised in that if the bill or voucher is indicated as being valid, then the same is moved by the feed means into a storage location.

8. Apparatus according to claim 7 characterised in that a second feed means is provided to move the bill or voucher to the storage location in a direction substantially perpendicular to the direction of the first feed means.

9. Apparatus according to claim 7 characterised in that the printer is located intermediate the aperture and the storage location.

10. Apparatus according to claim 1 characterised in that the bill or voucher which leaves the apparatus is the same bill or voucher which has been placed into the apparatus by the user in the same condition, or in an adapted form by printing thereon.

11. Gaming and/or payment apparatus incorporating the apparatus as defined in claim 1.

12. Apparatus for the receipt and provision of bills and/or vouchers, said apparatus including a printer and further incorporating an aperture through which bills or vouchers can pass between said apparatus and a user, and feed means which cause the passage of the bill and/or voucher within said apparatus and characterised in that feed means leading to and from the aperture can be driven in a first, forward direction so as to allow a bill or voucher to be moved in a first direction into the apparatus and in a second, reverse direction so as to allow a bill or voucher printed by the apparatus to move from the printer to external of the apparatus and the aperture through which the bill or voucher is placed into the apparatus is the same aperture through which a bill or voucher passes to leave the apparatus and the printer is located at an end of the feed means opposing an end at which said aperture is located such that said voucher, once printed, is passed by the feed means to the said same aperture to allow the same to be received and removed from the apparatus by a user.

13. Gaming and/or payment apparatus incorporating the apparatus as defined in claim 12.

14. Apparatus for the receipt and provision of bills and/or vouchers, said apparatus including a printer and further incorporating an aperture through which bills or vouchers can pass between said apparatus and a user, and a feeder which cause the passage of the bill and/or voucher within said apparatus and characterised in that said feeder leading to and from the aperture can be driven in a first, forward direction so as to allow a bill or voucher to be moved in a first direction into the apparatus and in a second, reverse direction so as to allow a bill or voucher printed by the apparatus to move from the printer to external of the apparatus and the aperture through which the bill or voucher is placed into the device is the same aperture through which a bill or voucher passes to leave the device.

* * * * *